US005720520A

United States Patent [19]

Bengtson et al.

[11] Patent Number: 5,720,520

[45] Date of Patent: Feb. 24, 1998

[54] DETACHABLE CHILD SEAT

[76] Inventors: Michaele L. Bengtson, 520 Cardinal Dr., South Sioux City, Nebr. 68776; Kristin B. Broyhill, 1401 Willow St. P.O. Box 648, Dakota City, Nebr. 68731; Stephanie J. Moulton, 586 Laura La., South Sioux City, Nebr. 68776; Eric S. Pfeifer, 557 Laura La., South Sioux City, Nebr. 68776; Stefanie N. Spirk, 842 - 137th St. P.O. Box 72, South Sioux City, Nebr. 68776; Tyler J. Todd, 620 E. 18th St., South Sioux City, Nebr. 68776

[21] Appl. No.: 800,060

[22] Filed: Feb. 14, 1997

[51] Int. Cl.[6] ..... A47D 1/10

[52] U.S. Cl. ..... 297/250.1; 297/136; 297/153; 297/DIG. 6; 297/251; 297/274

[58] Field of Search ..... 297/250.1, 251, 297/136, 153, 188.18, 174, DIG. 6

[56] References Cited

U.S. PATENT DOCUMENTS

| | | | |
|---|---|---|---|
| D. 315,252 | 3/1991 | Ho | D6/333 |
| D. 327,777 | 7/1992 | Tepper | D6/333 |
| 1,089,040 | 3/1914 | Block | 297/250.1 X |
| 1,739,366 | 12/1929 | Lang | 297/153 X |
| 1,950,042 | 3/1934 | Upper | 297/136 |
| 2,050,114 | 8/1936 | Moore | 297/153 X |
| 2,588,754 | 3/1952 | Novi | 297/136 |
| 3,155,426 | 11/1964 | Rockwell | 297/136 |
| 3,172,696 | 3/1965 | De Vos | 297/136 X |
| 3,515,429 | 6/1970 | Bollinger | 297/153 |
| 3,516,709 | 6/1970 | Nader | 297/153 |
| 4,226,467 | 10/1980 | Boudreau | 297/5 |
| 4,364,576 | 12/1982 | Kassai | 280/87.02 |
| 4,383,713 | 5/1983 | Roston | 297/DIG. 6 X |
| 4,650,246 | 3/1987 | Henriksson | 297/250 |
| 4,779,883 | 10/1988 | Paduano et al. | 280/289 |
| 5,007,653 | 4/1991 | Chen | 280/87.051 |
| 5,056,776 | 10/1991 | Cheng | 272/70.3 |
| 5,310,245 | 5/1994 | Lyszczasz | 297/DIG. 6 X |
| 5,317,765 | 6/1994 | Knoedler et al. | 4/572.1 |
| 5,401,076 | 3/1995 | Dunlap | 297/243 |

*Primary Examiner*—Jose V. Chen
*Assistant Examiner*—Rodney B. White
*Attorney, Agent, or Firm*—Zarley, McKee, Thomte, Voorhees & Sease; Mark D. Frederiksen

[57] ABSTRACT

A detachable infant seat includes a flat base board with a central aperture formed therethrough and a flexible fabric seat attached to the perimeter of the aperture and projecting downwardly therethrough to support an infant. The base board has an upright wall extending along the opposing side edges and the rearward edge of the board, and a back board pivotally connected to the rearward wall of the base board. The back board includes a pair of operable brackets connected between the back board and the base board to selectively retain the back board in an open position extending from the base board and generally parallel thereto, an upright position orthogonal to the base board, or a closed position pivoted over the top and proximal to the base board. A pair of straps are attached to the base board and extend around the arms of a wheelchair and are fastened to the base board, in order to detachably mount the base board to the arms of a wheelchair. Hook and loop fasteners on the back board permit the attachment of various accessory items to the back board.

7 Claims, 2 Drawing Sheets

DETACHABLE CHILD SEAT

TECHNICAL FIELD

The present invention relates generally to detachable seats for infants, and more particularly to a portable board which is detachably mounted on a wheelchair to aid a wheelchair bound person in the care of a baby.

BACKGROUND OF THE INVENTION

In the past, it has been quite difficult for a wheelchair bound person to care for a baby for anything more than a very short period of time. This is because it is difficult for the wheelchair rider to both hold the baby and operate the wheelchair, or perform other tasks. While the prior art discloses various types of child's seats which may be detachably mounted on a wheelchair, such as that disclosed in U.S. Pat. No. 5,401,076, typically such seats are mounted rearwardly of the rider, or with the child facing forwardly in front of the wheelchair rider. In both instances, it is difficult, if not impossible for the wheelchair rider to tend to the needs of the child.

in addition, infant seats for attachment to wheelchairs do not provide sufficient area for changes an infant's diaper, or for the attachment of various necessitates, such as a baby bottle or toys.

SUMMARY OF THE INVENTION

It is therefore a general object of the present invention to provide an improved detachable infant seat for a wheelchair.

Another object of the present invention is to provide a detachable infant seat which is easily folded for portability.

Still another object is to provide a detachable infant seat for wheelchairs which provides expandable space for changing a baby's diaper, or attachment of accessory items.

Still another object of the present invention is to provide a detachable infant seat which is easily mounted and removed from a wheelchair.

These and other objects of the present invention will be apparent to those skilled in the art.

The detachable infant seat of the present invention includes a flat base board with a central aperture formed therethrough and a flexible fabric seat attached to the perimeter of the aperture and projecting downwardly therethrough to support an infant. The base board has an upright wall extending along the opposing side edges and the rearward edge of the board, and a back board pivotally connected to the rearward wall of the base board. The back board includes a pair of operable brackets connected between the back board and the base board to selectively retain the back board in an open position extending from the base board and generally parallel thereto, an upright position orthogonal to the base board, or a closed position pivoted over the top and proximal to the base board. A pair of straps are attached to the base board and extend around the arms of a wheelchair and are fastened to the base board, in order to detachably mount the base board to the arms of a wheelchair. Hook and loop fasteners on the back board permit the attachment of various accessory items to the back board.

DESCRIPTION OF THE PREFERRED EMBODIMENT

Figure 1:
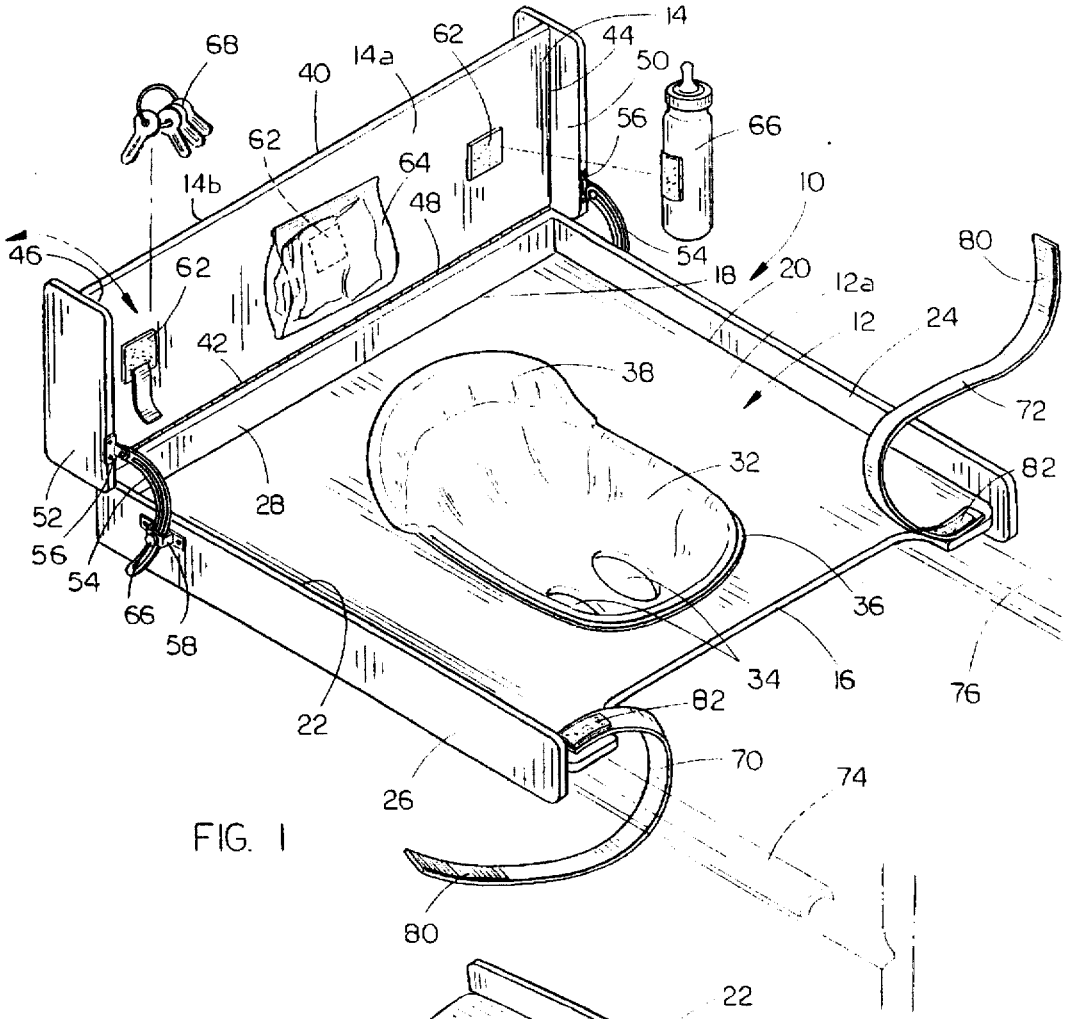
FIG. 1 is a perspective view of the detachable infant seat of the present invention, with the arms of a wheelchair shown in broken lines.

Referring now to the drawings, in which similar or corresponding parts are identified with the same reference numeral and more particularly to FIG. 1, the detachable infant seat of the present invention is designated generally at 10 and includes a generally flat base board 12 with a back board 14 operably connected to a rearward edge of the base board, to permit movement between an upright position and a folded storage position.

Base board 12 includes an upper surface **12*a* and a lower surface 12*b* (shown in FIG. 2), with a forward edge 16, rearward edge 18 and opposing side edges 20 and 22 respectively. A first upright wall 24 extends along the length of side edge 20, and projects upwardly beyond the upper surface of base board 12, and downwardly below the lower surface 12*b* of base board 12. A second wall 26 extends along the length of second side edge 22, and projects beyond the upper and lower surfaces of base board 12, in a similar manner. A third wall 28 extends along the rearward edge of base board 12 and projects beyond the upper and lower surfaces of the base board 12 similar to the first and second walls. It can be seen that walls 24, 26, and 28 are connected to form boundary walls along the side edges and rearward edges of base board 12** to prevent toys or other items from sliding off of the base board.

A large central aperture 30 is formed through base board 12 which will receive a conventional fabric seat 32 therein for supporting a baby. Seat 32 includes a pair of leg holes 34, and is fastened around a peripheral edge 36 to the circumference of aperture 30. A padded headrest 38 may be mounted along the rearward edge of seat 32 in a conventional manner.

Back board 14 is shown in the upright position in FIG. 1, and includes a forward surface **14*a* and rearward surface 14*b*, as well as an upper edge 40, lower edge 42, and opposing side edges 44 and 46. Back board 14 is pivotally connected along its lower edge 42 along the upper edge of the third upright wall 28 of base board 12, by a piano hinge 48**.

Figure 2:
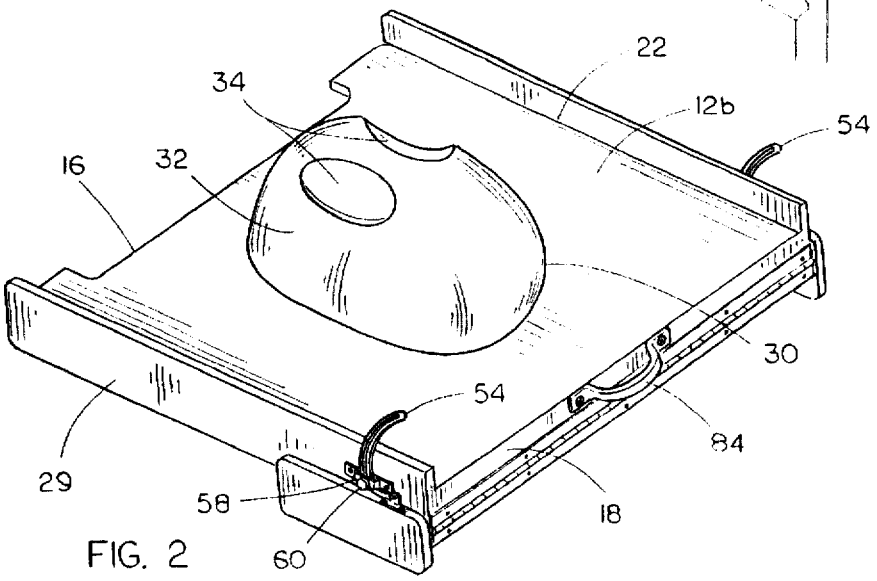
FIG. 2 is a perspective view of the infant seat taken from the underside of the seat, and with the seat folded to a storage position.

A pair of side walls 50 and 52 are attached to side edges 44 and 46 of back board 14 and project forwardly and rearwardly beyond the forward and rearward surfaces of back wall 14. A pair of curved guide arms 54 have one end pivotally connected to a bracket 56 fastened to a forward edge of side walls 50 and 52, and project forwardly and downwardly therefrom. A receiver bracket 58 is mounted on the outer surface of each of first and second walls 24 and 26, with the second end of guide arms 54 slidably journaled therethrough. Receiver brackets 58 include a set screw 60 which may be tightened to fix guide arm 54 in the desired position in receiver bracket 58, and thereby retain back board 14 in the desired pivotal position relative to base board 12. Preferably, back board 14 may be pivoted 180° from a folded position in abutting contact with the upper edges of side walls 24, 26, and 28 (as shown in FIG. 2) to an extended position extending forwardly generally parallel to base board 12. The extended position provides additional surface area for changing diapers and the like.

A plurality of patches 62 of hook and loop fastener material are mounted to the forward surface **14*a* of back board 14 for the selective attachment of a diaper bag 64, a baby bottle 66, and/or various toys 68**.

Figure 3:
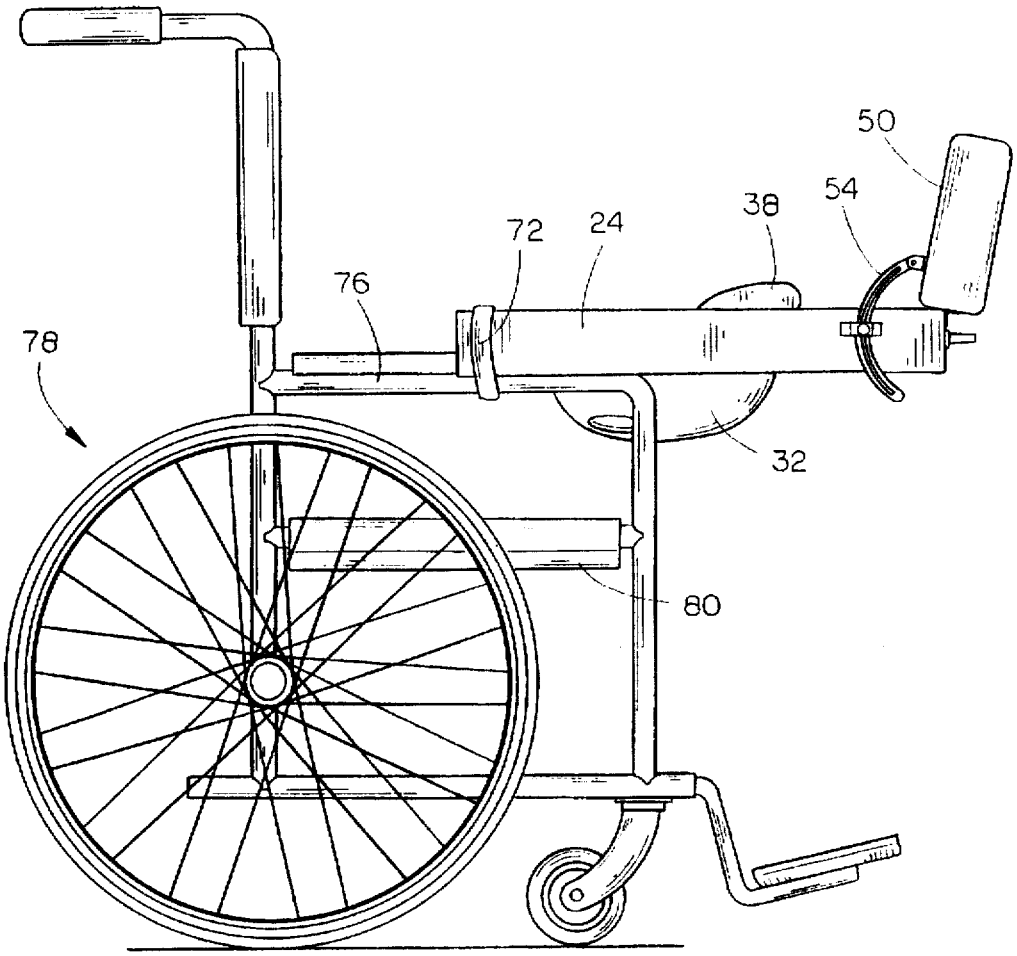
FIG. 3 is a side elevational view of the infant seat of the present invention attached to a wheelchair.
Figure 4:
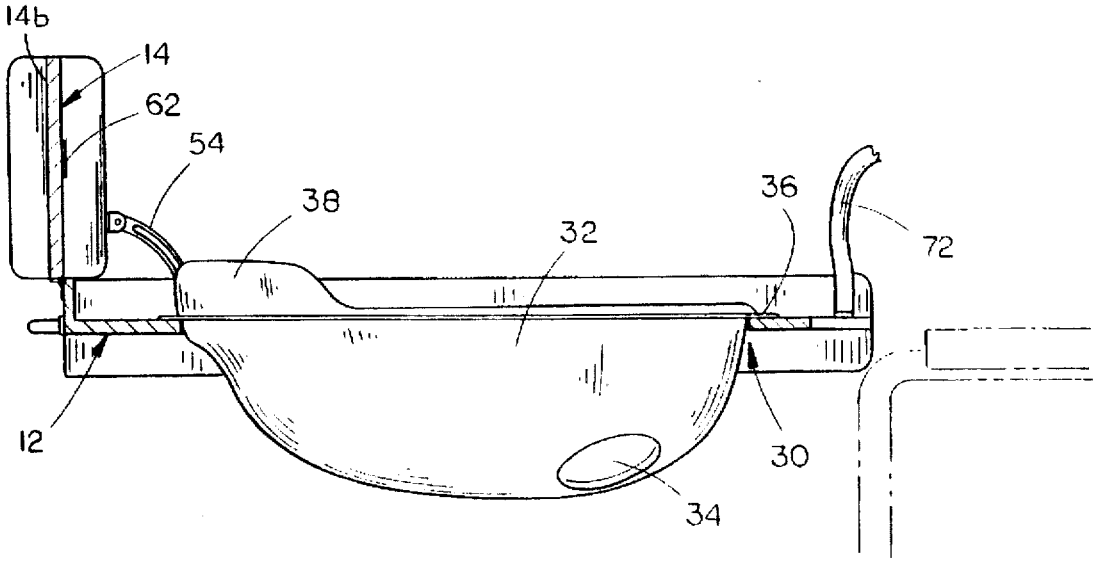
FIG. 4 is a sectional view taken at lines 4—4 in FIG. 1.

A pair of elongated straps 70 and 72 have a first end fastened to the upper surface 12*a* of base board 12 adjacent the forward edge 16 thereof. The second end of straps 70 and 72 may then be wrapped around the arms 74 and 76 of a wheelchair 78, as shown in FIG. 3, to secure the board in a generally horizontal position over the seat 80 of the wheelchair 78. The free ends of straps 70 and 72 have hook and loop fastener material 80 thereon for selective securement to corresponding hook and loop fastener material 82 on the first ends of the straps, where fastened to the base board 12. In this way, straps 70 and 72 may be tightened to fit the wheelchair arms.

Preferably, the forward edge 16 of base board 12 is curved to form a notch extending inwardly into the base board, thereby providing more room for the wheelchair rider.

Referring once again to FIG. 2, a handle 84 is mounted on the rearward edge of base board 12 and projects therefrom. When back board 14 is folded to the storage position shown in FIG. 2, handle 84 permits easy transportability of the detachable infant seat 10.

Whereas the invention has been shown and described in connection with the preferred embodiment thereof, many modifications, substitutions and additions may be made which are within the intended broad scope of the appended claims.

We claim:

1. An infant seat for detachable connection to a chair having arms, comprising:

a generally planar base, having upper and lower surfaces, forward and rearward edges, and opposing first and second side edges;

a first side wall extending continuously along an entire length of the first side edge of the base and projecting upwardly and downwardly therefrom;

a second side wall extending continuously along an entire length of the second side edge of the base and projecting upwardly and downwardly therefrom; and a third side wall extending continuously along an entire length of the rearward edge of the base and projecting upwardly and downwardly therefrom, said third side wall being connected to the first and second side walls;

an aperture formed through the base and generally centered in the upper surface thereof;

a seat member attached to the base around the aperture and projecting downwardly through the aperture, for supporting an infant in the aperture of the base;

seat member being formed of a flexible material having a pair of leg openings therethrough; and means on the base for selectively attaching the base to arms of a chair, said attaching means including a pair of straps, each strap having a first end attached to the base and a second end having a first half of a cooperable fastener thereon for selective securement to a second half of a cooperable fastener mounted on the base.

2. The infant seat of claim 1, further comprising:

a generally planar back board having forward and rearward surfaces, upper and lower edges, an opposing first and second side edges;

said back board pivotally connected along its lower edge to said base board for selective pivotal movement between an open position generally parallel to the base and projecting outwardly therefrom, an upright position generally orthogonal to the base, and a closed position generally parallel to the base and positioned spaced above and proximal to the base.

3. The infant seat of claim 2, further comprising means connected between the back board and the base for selectively holding the base in any one of a plurality of positions between the open and closed positions, said holding means preventing pivotal movement of the back board beyond the open position.

4. The infant seat of claim 3, wherein said back board is pivotally connected to the base continuously along an upper edge of the third wall.

5. The infant seat of claim 4, further comprising one-half of a two-part fastener, mounted on the forward surface of the back board, the second half of the fastener mounted on an item to be selectively fastened to the back board.

6. The infant seat of claim 1, wherein said back board has a length measured from the rearward edge to the forward edge which is less than the length of the base.

7. The infant seat of claim 6, wherein the back board has a length less than the distance between the rearward edge of the base and the aperture in the base, such that the backboard pivots to the closed position rearwardly of the seat.

* * * * *